US010392226B2

(12) United States Patent
Hida

(10) Patent No.: US 10,392,226 B2
(45) Date of Patent: Aug. 27, 2019

(54) MACHINE ROOM-LESS ELEVATOR

(71) Applicant: MITSUBISHI ELECTRIC CORPORATION, Chiyoda-ku (JP)

(72) Inventor: Masahiko Hida, Chiyoda-ku (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 207 days.

(21) Appl. No.: 15/311,291

(22) PCT Filed: Jul. 3, 2014

(86) PCT No.: PCT/JP2014/067773

§ 371 (c)(1),
(2) Date: Nov. 15, 2016

(87) PCT Pub. No.: WO2016/002042

PCT Pub. Date: Jan. 7, 2016

(65) Prior Publication Data

US 2017/0107083 A1 Apr. 20, 2017

(51) Int. Cl.
*B66B 11/00* (2006.01)
*B66B 9/00* (2006.01)

(52) U.S. Cl.
CPC ..... *B66B 11/0045* (2013.01); *B66B 9/00* (2013.01); *B66B 11/0005* (2013.01); *B66B 11/008* (2013.01)

(58) Field of Classification Search
CPC .. B66B 11/0045; B66B 11/0005; B66B 9/187
See application file for complete search history.

(56) References Cited

U.S. PATENT DOCUMENTS 3,759,349 A * 9/1973 Sieffert
5,033,586 A * 7/1991 Richards et al.
8,820,483 B2 * 9/2014 Ericson ..... B66B 19/005 187/266

FOREIGN PATENT DOCUMENTS

| | | | | |
|---|---|---|---|---|
| DE | 202014000273 U1 * | 4/2014 | ..... | B66B 11/00 |
| EP | 1 792 868 A1 | 6/2007 | | |
| JP | 2000-86126 A | 3/2000 | | |
| JP | 2004-196468 A | 7/2004 | | |
| JP | 2005-112487 A | 4/2005 | | |
| JP | 2009-137695 A | 6/2009 | | |
| JP | 2012-510943 A | 5/2012 | | |
| WO | 2006/033160 A1 | 3/2006 | | |

OTHER PUBLICATIONS

Machine Translation DE 20 2014 000 273 Jan. 2014.*
International Search Report dated Sep. 30, 2014 in PCT/JP2014/067773 filed Jul. 3, 2014.

* cited by examiner

*Primary Examiner* — Diem M Tran
(74) *Attorney, Agent, or Firm* — Xsensus, LLP

(57) ABSTRACT

A machine room-less elevator includes a car configured to ascend and descend in a hoistway of an architectural structure, a counter weight configured to ascend and descend reversely to the car, a rope configured to suspend the car and the counter weight, and a hoisting machine configured to drive the rope. A support beam assembly, which is configured to bear not a load of the architectural structure but at least loads of the car, the counter weight, the rope, and the hoisting machine, is supported on a top-story floor beam assembly of the architectural structure.

6 Claims, 6 Drawing Sheets

MACHINE ROOM-LESS ELEVATOR

TECHNICAL FIELD

The present invention relates to a machine room-less elevator.

BACKGROUND ART

For example, as described in Patent Literature 1, a car and a counter weight are arranged in a hoistway for an elevator in an ascendable and descendable manner. The car and the counter weight are suspended by a rope that is driven by a hoisting machine. When the rope is driven by the hoisting machine, the car and the counter weight ascend and descend in reverse directions to each other.

Further, in a machine room-less elevator, rails often bear a load of the elevator. The rails bear the load of the elevator so that the machine room-less elevator is structured to avoid dependence on a building side as much as possible. Accordingly, there are advantages in that requirements of an architectural structure (for example, adjustment of a position of a beam configured to bear the load) can be reduced at a designing stage (a time period for design can be reduced), and that a position of an apparatus can be precisely set with reference to the rails.

CITATION LIST

Patent Literature

[PTL 1] WO 2006/033160

SUMMARY OF INVENTION

Technical Problem

However, the existing machine room-less elevator obtains the above-mentioned advantages, but has the structure in which the rails bear the load of the elevator. Thus, sizes of the rails are increased, and a cost ratio of the rails to the elevator is increased along with increase in ascending and descending distance. Consequently, there is a problem causing increase in cost. Further, in the existing machine room-less elevator, a beam (hoisting machine support beam, return wheel beam, or rope retaining beam) configured to bear the load of the elevator is additionally arranged at a position at which no beam of the architectural structure is arranged originally. Accordingly, it has been difficult to directly join the additionally-arranged beam onto the architectural structure in order to cause the architectural structure to also bear the load.

The present invention has been made in view of the above, and has an object to provide a machine room-less elevator capable of downsizing rails and achieving reduction in apparatus cost.

Solution to Problem

In order to achieve the above-mentioned object, according to one embodiment of the present invention, there is provided a machine room-less elevator, including: a car configured to ascend and descend in a hoistway of an architectural structure; a counter weight configured to ascend and descend reversely to the car; a rope configured to suspend the car and the counter weight; and a hoisting machine configured to drive the rope, in which a support beam assembly, which is configured to bear not a load of the architectural structure but at least loads of the car, the counter weight, the rope, and the hoisting machine, is supported on a top-story floor beam assembly of the architectural structure.

Advantageous Effects of Invention

According to the present invention, the rails can be downsized, and the reduction in apparatus cost can be achieved.

DESCRIPTION OF EMBODIMENTS

Figure 1:
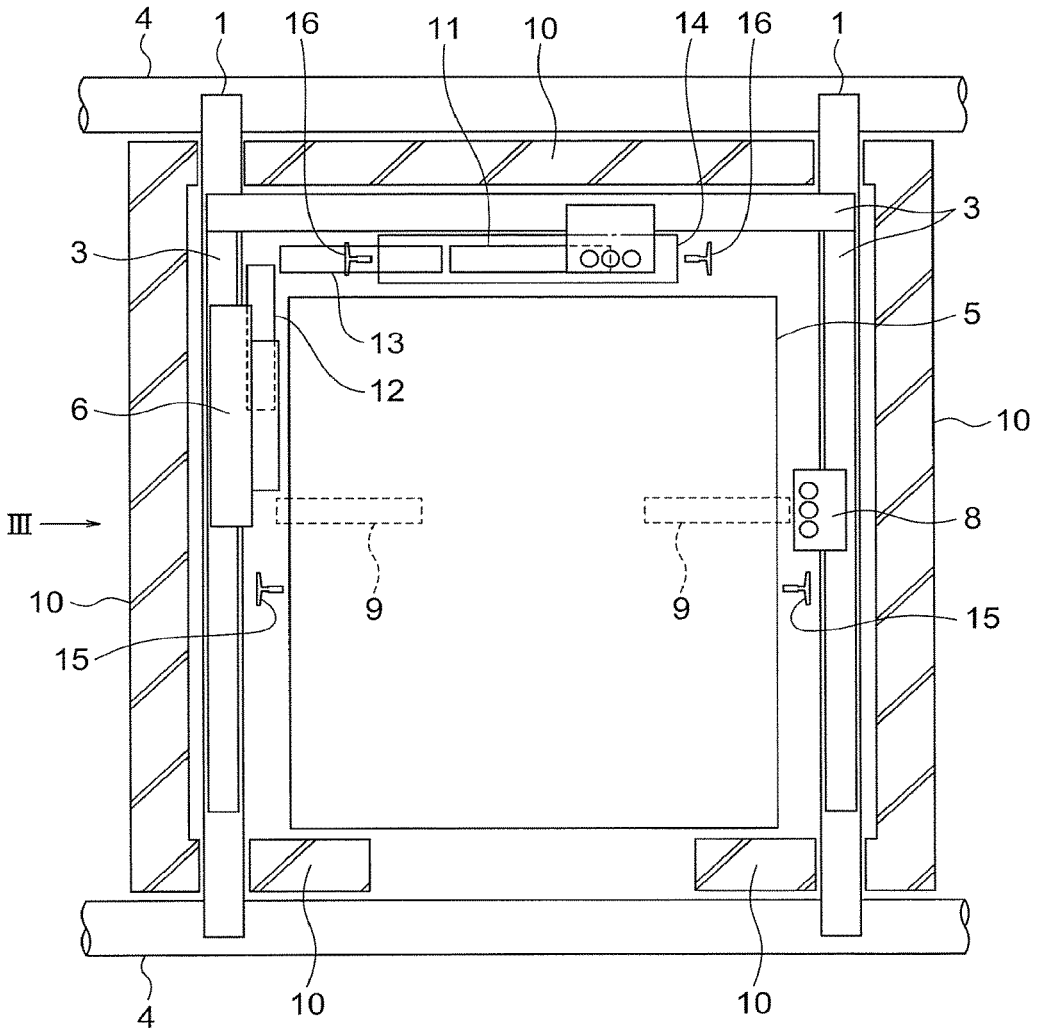
FIG. 1 is a plan view for illustrating a machine room-less elevator according to a first embodiment of the present invention.

Now, a machine room-less elevator according to embodiments of the present invention is described with reference to the attached drawings. In the drawings, the same reference numerals represent the same or corresponding components. In the following description, a direction vertical to the drawing sheet of a plan view of FIG. 1 is referred to as an "up-and-down direction", and a transverse direction of the drawing sheet of FIG. 1 is referred to as a "transverse direction". Further, an up-and-down direction of the drawing sheet of FIG. 1 is referred to as a "longitudinal direction (direction in which an occupant gets on and off, or a depth direction of a car chamber)".

First Embodiment

Figure 2:
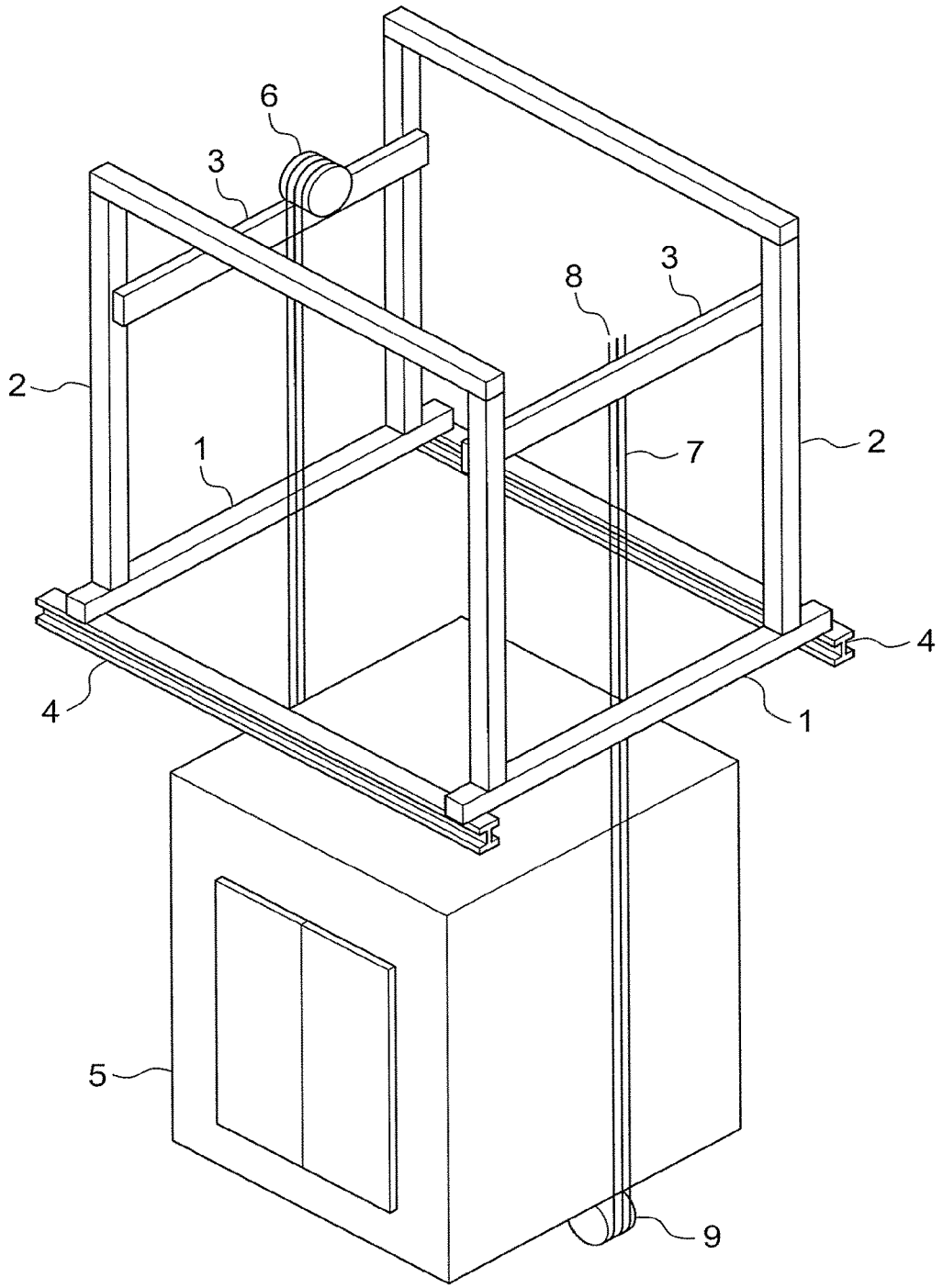
FIG. 2 is a view for schematically illustrating a relationship between a car of the machine room-less elevator and a beam assembly according to the first embodiment.
Figure 3:
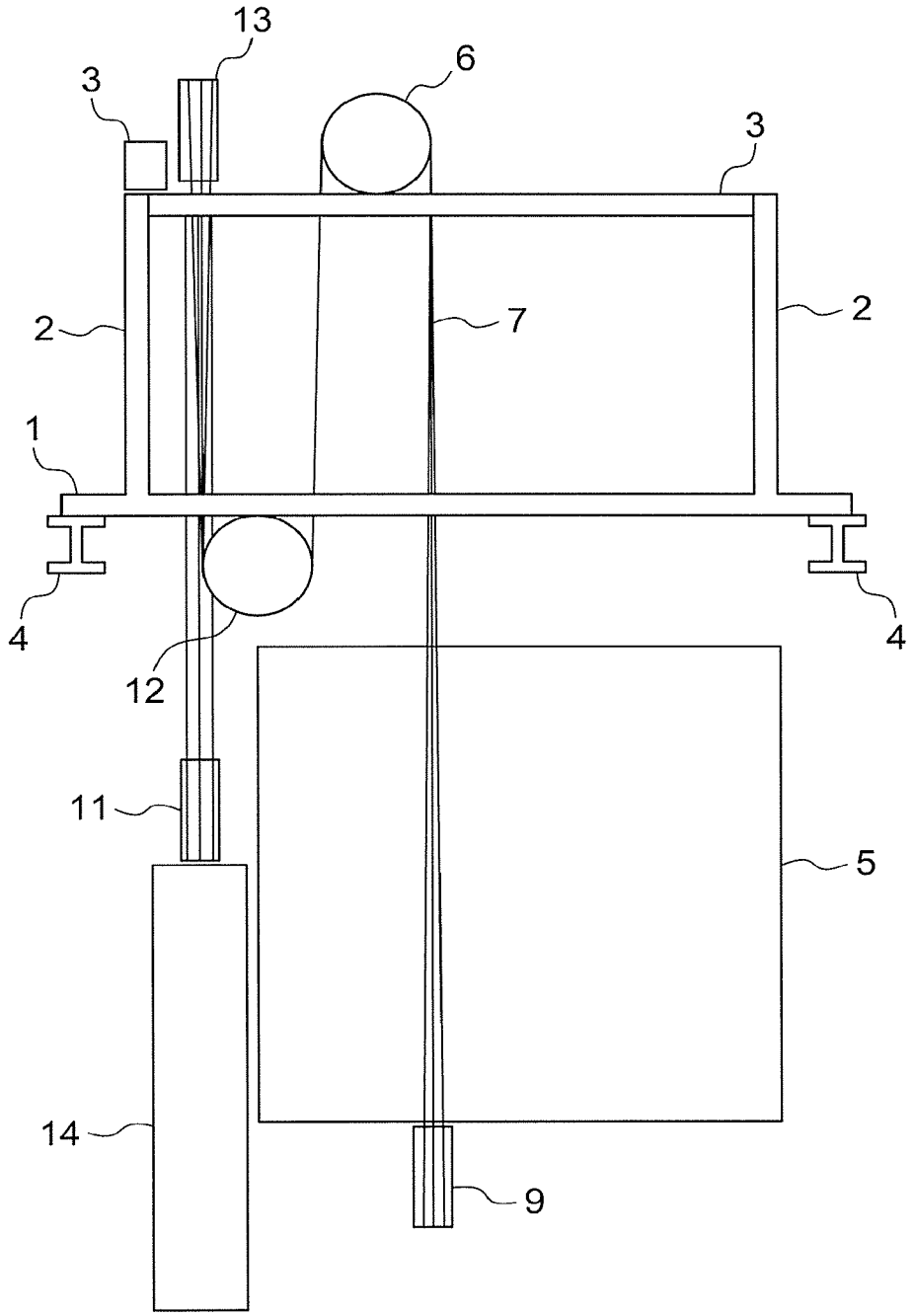
FIG. 3 is a view for illustrating main components of the machine room-less elevator when seen from the arrow III of FIG. 1.

FIG. 1 is a plan view for illustrating a machine room-less elevator according to a first embodiment of the present invention. FIG. 2 is a view for schematically illustrating a relationship between a car of the machine room-less elevator and a beam assembly according to the first embodiment. FIG. 3 is a view for illustrating main components of the machine room-less elevator when seen in a lateral direction (from the arrow III) of FIG. 1.

The elevator includes a car 5 and a counter weight 14 configured to ascend and descend in a hoistway defined by hoistway walls 10, a pair of right and left car guide rails 15, and a pair of right and left counter weight guide rails 16. The pair of right and left car guide rails 15 and the pair of right and left counter weight guide rails 16 extend in the hoistway in the up-and-down direction. In the first embodiment of a weight rear drop type, the counter weight 14 is arranged on a rear side of the car 5 (opposite side of a doorway) in plan view.

The car 5 is arranged between the pair of right and left car guide rails 15, and is guided in an ascending and descending direction under a state of being restrained by the car guide rails 15 from moving in a horizontal direction of the car. Similarly, the counter weight 14 is arranged between the pair of right and left counter weight guide rails 16, and is guided in the ascending and descending direction under a state of being restrained by the counter weight guide rails 16 from moving in a horizontal direction of the counter weight 14.

The car 5 and the counter weight 14 are suspended by a rope 7. Further, a hoisting machine 6 is arranged at a top of the hoistway, and the rope 7 is wound on a sheave of the hoisting machine 6. Specifically, a part of the rope 7 extending from one side of the hoisting machine 6 is wound on a car suspension wheel 9 arranged on a lower portion of the car 5. Another part of the rope 7 extending from another side of the hoisting machine 6 is wound on a car-side return wheel 12 and a counter-weight-side return wheel 13, and is also wound on a counter weight suspension wheel 11. When the rope 7 is driven by the hoisting machine 6 in this winding of the rope 7, the car 5 and the counter weight 14 ascend and descend in vertically reverse directions to each other.

In an upper portion of the hoistway, a support beam assembly configured to bear not a load of an architectural structure but only a load of an elevator apparatus arranged in the hoistway is supported on a top-story floor beam assembly 4 of the architectural structure. The top-story floor beam assembly 4 constructs a part of the architectural structure arranged in a top-story floor portion in the hoistway, and bears the load of the architectural structure including the hoistway.

Meanwhile, the support beam assembly bears not the load of the architectural structure but at least loads of the car 5, the counter weight 14, the rope 7, and the hoisting machine, and includes a first support beam unit 1, a second support beam unit 2, and a third support beam unit 3. The support beam assembly (the first support beam unit 1, the second support beam unit 2, and the third support beam unit 3) is fixed so as to be placed on the top-story floor beam assembly 4 of the architectural structure.

The first support beam unit 1 includes a pair of beam members extending horizontally and in parallel to each other. The pair of beam members of the first support beam unit 1 extends so as to bridge a corresponding pair of beam members of the top-story floor beam assembly 4, and is fixed on the top-story floor beam assembly 4.

The second support beam unit 2 includes a pair of U-shaped beam members. Each of the U-shaped beam members includes a pair of leg portions extending vertically (in the up-and-down direction or orthogonally) from the separate beam members of the first support beam unit 1, respectively, and a bridge portion extending so as to connect upper portions of the pair of leg portions to each other.

The third support beam unit 3 includes a pair of beam members extending horizontally and in parallel to each other. The pair of beam members of the third support beam unit 3 is parallel to the pair of beam members of the first support beam unit 1. Each of the beam members of the third support beam unit 3 bridges a corresponding pair of the leg portions of the second support beam unit 2.

The above-mentioned hoisting machine 6 is mounted on one of the beam members of the third support beam unit 3. A rope retaining portion 8 is mounted on another one of the beam members of the third support beam unit 3. Further, the car-side return wheel 12 is mounted on the first support beam unit 1.

The first support beam unit 1, the second support beam unit 2, the third support beam unit 3, and the hoisting machine 6 exist in a gap between the car 5 and the hoistway walls 10 when seen in plan view in a projected manner. Accordingly, under a state in which an upper portion of the car 5 is positioned above the top-story floor beam assembly 4, the car 5 can land at a top story. Thus, a so-called machine room-less elevator is constructed.

According to the above-mentioned machine room-less elevator of the first embodiment, the beam assembly (first to third support beam units), to which the load of the elevator is applied, is arranged on the top-story floor beam assembly of the top-story floor that always exists in the architectural structure. Thus, the architectural structure can bear the load of the elevator. Accordingly, the rails of the machine room-less elevator can be downsized, and reduction in apparatus cost can be achieved.

Further, by using the beam assembly of the architectural structure that always exists in the top-story floor, a position of bearing the load is clarified at an architecture designing stage. Consequently, it is not necessary to prepare the beam assembly at a special position in the architectural structure. Further, the first support beam unit, the second support beam unit, and the third support beam unit are arranged, with the result that no limitation is imposed on the position of bearing the load of the elevator. Thus, there is an advantage in that a degree of freedom in layout is enhanced.

Second Embodiment

Figure 4:
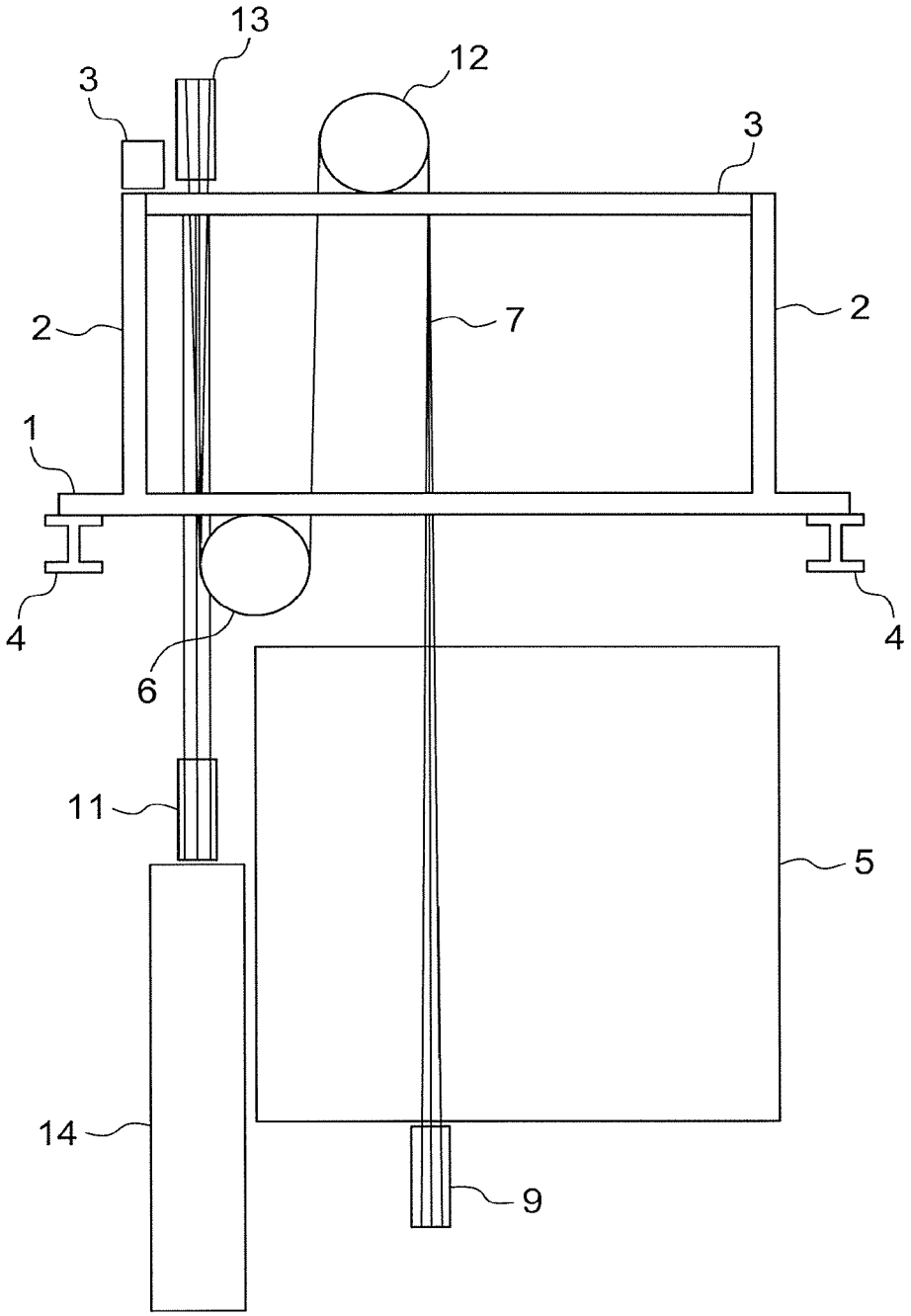
FIG. 4 is a view for illustrating a second embodiment of the present invention in a similar manner to FIG. 3.

Next, a second embodiment of the present invention is described with reference to FIG. 4. FIG. 4 is a view for illustrating the second embodiment in a similar manner to FIG. 3. The second embodiment is the same as the above-mentioned first embodiment except for components to be described below.

In the second embodiment, the mounting positions of the hoisting machine and the car-side return wheel in the configuration of the first embodiment are exchanged with each other. That is, in the second embodiment, the hoisting machine 6 is mounted on the first support beam unit 1, whereas the car-side return wheel 12 is mounted on one of the beam members of the third support beam unit 3.

Also in the second embodiment configured as described above, the same advantage as that of the above-mentioned first embodiment can be obtained. Further, in the second embodiment, there is also an advantage in that a maintenance space for the hoisting machine can be secured easily as compared to a case where the hoisting machine is mounted on the third support beam unit.

Third Embodiment

Figure 5:
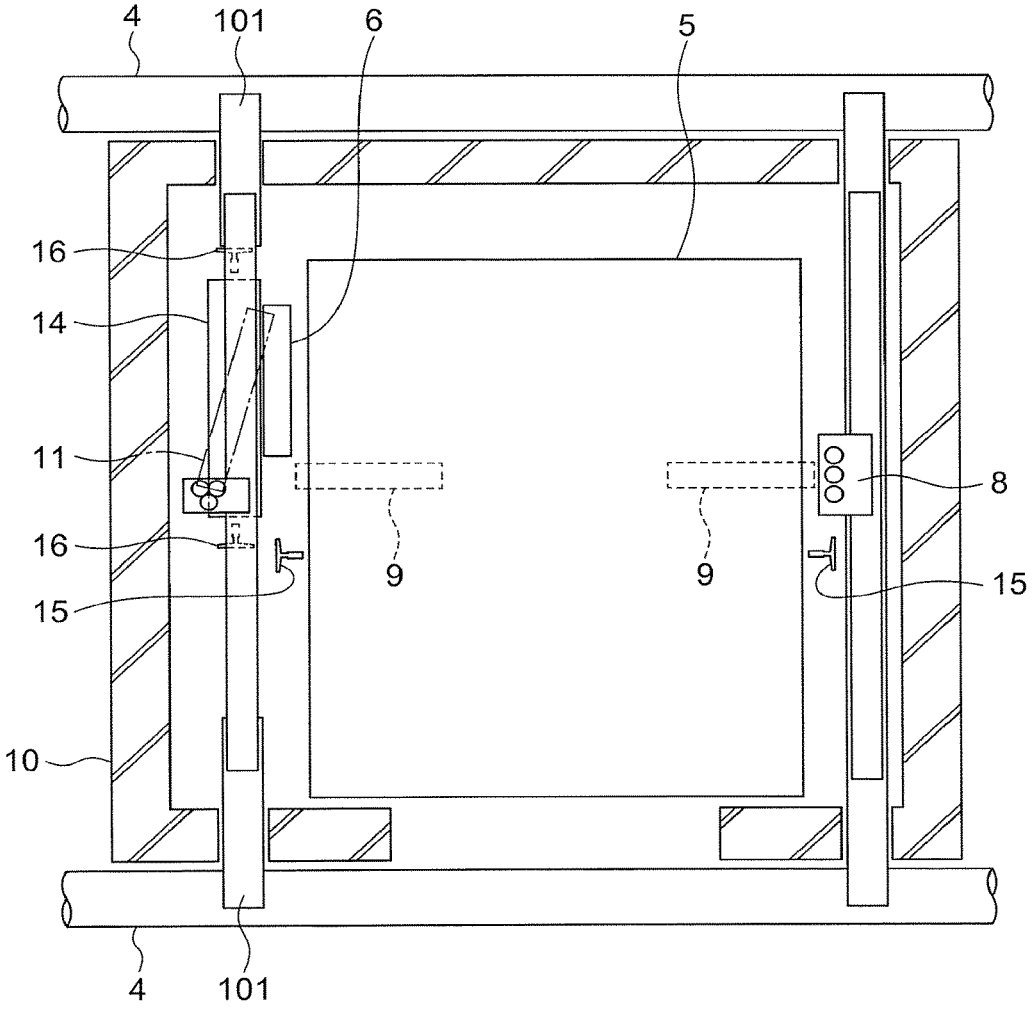
FIG. 5 is a view for illustrating a third embodiment of the present invention in a similar manner to FIG. 1.
Figure 6:
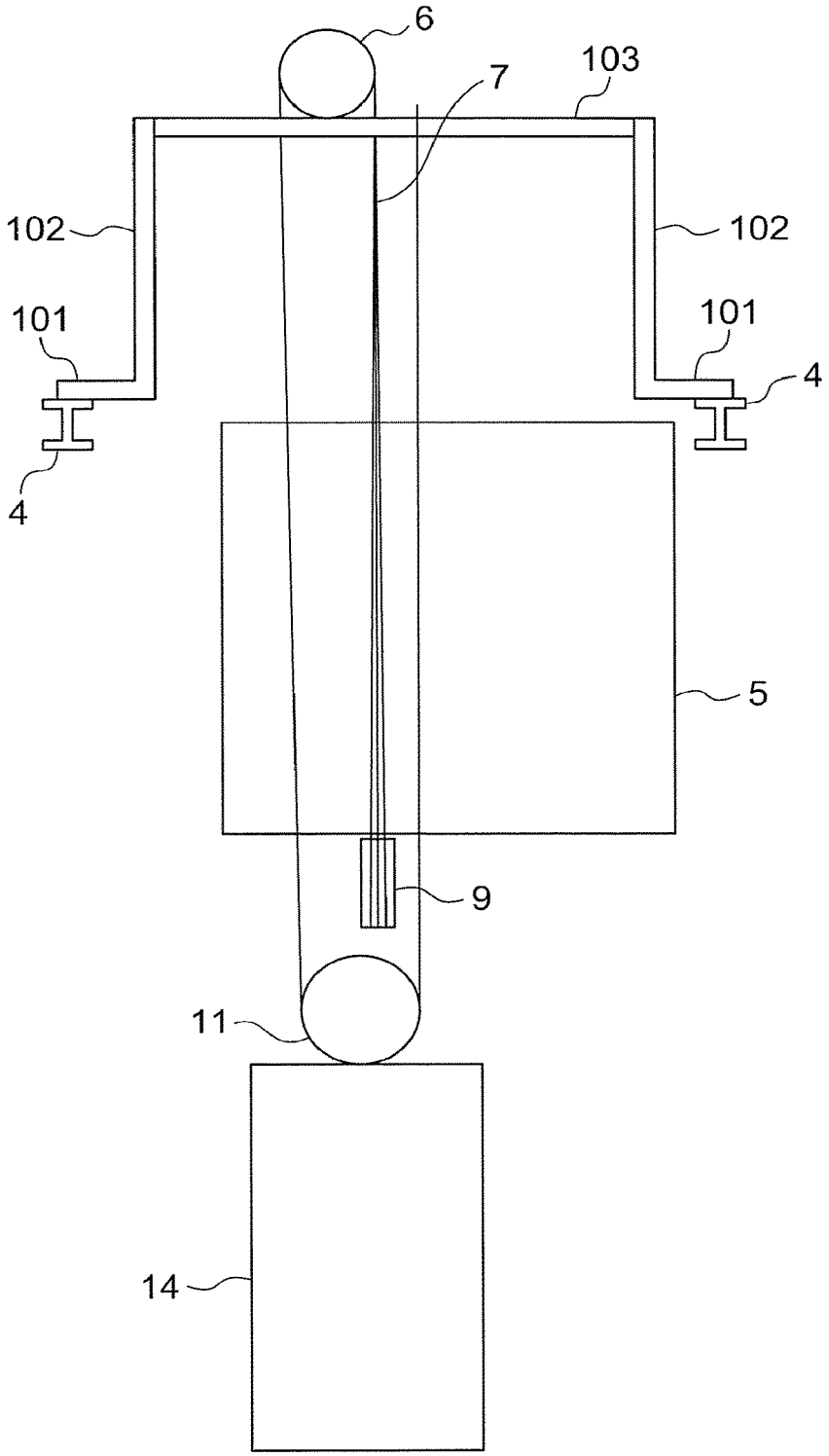
FIG. 6 is a view for illustrating the third embodiment in a similar manner to FIG. 3.

Next, a third embodiment of the present invention is described with reference to FIG. 5 and FIG. 6. FIG. 5 and FIG. 6 are views for illustrating the third embodiment in a similar manner to FIG. 1 and FIG. 3, respectively. The third embodiment is the same as the above-mentioned first embodiment except for components to be described below.

In the third embodiment of a weight side drop type, the counter weight 14 is arranged at a side of the car 5 in plan view, and the return wheel is not needed. A first support beam unit 101, a second support beam unit 102, and a third support beam unit 103 are arranged above the top-story floor beam assembly 4.

The first support beam unit 101 includes a pair of beam members extending horizontally on a common straight line. The first support beam unit 101 does not extend so as to bridge the pair of beam members of the top-story floor beam assembly 4 in a connecting manner. Each of the pair of beam members of the first support beam unit 101 is terminated after extending from corresponding one of the beam members of the top-story floor beam assembly 4.

The second support beam unit 102 includes a pair of pillar members each extending vertically from corresponding one of the beam members of the first support beam unit 101. In addition, the third support beam unit 103 extends horizontally, and extends so as to connect upper portions of the pair of pillar members of the second support beam unit 102 to each other. The hoisting machine 6 is mounted on the third support beam unit 103.

The first support beam unit 101, the second support beam unit 102, the third support beam unit 103, and the hoisting machine 6 exist in the gap between the car 5 and the hoistway walls 10 when seen in plan view in a projected manner. Accordingly, also in the third embodiment, under the state in which the upper portion of the car 5 is positioned above the top-story floor beam assembly 4, the car 5 can land at the top story. Thus, the so-called machine room-less elevator is constructed.

Also in the third embodiment configured as described above, the same advantage as that of the above-mentioned first embodiment can be obtained.

Although the details of the present invention are specifically described above with reference to the preferred embodiments, it is apparent that persons skilled in the art may adopt various modifications based on the basic technical concepts and teachings of the present invention.

REFERENCE SIGNS LIST

1, 101 first support beam unit 2, 102 second support beam unit 3, 103 third support beam unit 4 top-story floor beam assembly 5 car 6 hoisting machine 7 rope 10 hoistway wall 14 counter weight

The invention claimed is:

1. A machine room-less elevator, comprising:

a car configured to ascend and descend in a hoistway of an architectural structure;

a counter weight configured to ascend and descend reversely to the car;

a rope configured to suspend the car and the counter weight; and a hoisting machine configured to drive the rope, wherein a support beam assembly, which is configured to bear not a load of the architectural structure but at least loads of the car, the counter weight, the rope, and the hoisting machine, is supported on a top-story floor beam assembly of the architectural structure, and wherein the elevator services and lands at the top story floor, wherein the support beam assembly and the hoisting machine exist in a gap between the car and a hoistway wall when seen in plan view in a projected manner, wherein the support beam assembly comprises a first support beam unit, a second support beam unit, and a third support beam unit, wherein the first support beam unit comprises a pair of beams extending horizontally and in parallel to each other, each beam of the pair of beams of the first support beam unit including ends, wherein each of the pair of beams of the first support beam unit extends so as to bridge a corresponding pair of beams of the top-story floor beam assembly, is supported by the top-story floor beam assembly such that the top-story floor beam assembly bears the load of at least the car, and is fixed to the top-story floor beam assembly at the ends of the pair of beams of the first beam unit, wherein the second support beam unit comprises a pair of beams members, wherein each of the pair of beam members of the second support beam unit includes a pair of legs each extending vertically from a corresponding one of the beams of the first support beam unit, and wherein for each pair of legs, a bridge portion connects the pair of legs to each other, wherein the third support beam unit comprises a pair of beams extending horizontally and in parallel to each other, and wherein the pair of beams of the third support beam unit is parallel to the pair of beams of the first support beam unit, and each of the pair of beams of the third support beam unit bridges a corresponding pair of the legs of the second support beam unit.

2. A machine room-less elevator according to claim 1, wherein the hoisting machine is mounted on one of the beams of the third support beam unit.

3. A machine room-less elevator according to claim 1, wherein the hoisting machine is mounted on one of the beams of the first support beam unit.

4. A machine room-less elevator according to claim 1, wherein:

the hoisting machine is mounted at a side of the hoistway such that the portion of the rope which is suspended by the hoisting machine and lifts the car passes the car passes along a side of the car.

5. A machine room-less elevator according to claim 4, further comprising:

a car suspension wheel mounted under the car which guides the rope directly below the car.

6. A machine room-less elevator, comprising:

a car configured to ascend and descend in a hoistway of an architectural structure;

a counter weight configured to ascend and descend reversely to the car;

a rope configured to suspend the car and the counter weight; and a hoisting machine configured to drive the rope, wherein a support beam assembly, which is configured to bear not a load of the architectural structure but at least loads of the car, the counter weight, the rope, and the hoisting machine, is supported on a top-story floor beam assembly of the architectural structure, and wherein the elevator services and lands at the top story floor, wherein the support beam assembly and the hoisting machine exist in a gap between the car and a hoistway wall when seen in plan view in a projected manner, wherein the support beam assembly comprises a first support beam unit, a second support beam unit, and a third support beam unit, wherein the first support beam unit comprises a pair of beams extending horizontally on a common straight line, wherein the first support beam unit does not extend so as to bridge a pair of beams of the top-story floor beam assembly in a connecting manner, but each of the pair of beams of the first support beam unit is terminated after extending from corresponding one of the beams of the top-story floor beam assembly, wherein the second support beam unit comprises two pair of pillars each one of the two pairs of pillars extending vertically from corresponding one of the beams of the first support beam unit, wherein the third support beam unit comprises a pair of beams extending horizontally, as to connect upper portions of corresponding pair of pillars of the second support beam unit to each other, and wherein the hoisting machine is mounted on one of the beams of the third support beam unit.

* * * * *